US010024281B2

(12) United States Patent
Lohr

(10) Patent No.: US 10,024,281 B2
(45) Date of Patent: Jul. 17, 2018

(54) INTAKE MANIFOLD INTEGRATED VACUUM SOLENOID

(71) Applicant: Ford Global Technologies, LLC, Dearborn, MI (US)

(72) Inventor: John Carl Lohr, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 285 days.

(21) Appl. No.: 14/842,474

(22) Filed: Sep. 1, 2015

(65) Prior Publication Data

US 2017/0058844 A1 Mar. 2, 2017

(51) Int. Cl.
*F02M 35/104* (2006.01)

(52) U.S. Cl.
CPC ..... *F02M 35/104* (2013.01)

(58) Field of Classification Search
CPC ..... F02M 35/104; F16L 3/00; F16K 51/00
USPC ..... 123/184.21; 251/129.15, 64; 137/315.03
See application file for complete search history.

(56) References Cited

U.S. PATENT DOCUMENTS 4,842,010 A * 6/1989 Edgecomb ..... F16H 61/0009 137/343
5,722,367 A * 3/1998 Izydorek ..... F02M 3/09 123/339.13
5,967,487 A * 10/1999 Cook ..... F02M 25/0836 251/129.07
6,085,615 A * 7/2000 Kirkendall ..... F16H 61/0009 74/606 R
6,170,516 B1 * 1/2001 Sakata ..... F02M 25/0836 137/343
6,539,971 B2 * 4/2003 Moreno ..... F16K 27/003 137/15.18
6,955,337 B2 * 10/2005 Weber ..... F16K 31/0651 137/315.03
8,413,641 B2 * 4/2013 Fornara ..... F02M 25/0836 123/520
8,561,964 B2 * 10/2013 Zhan ..... F16K 31/04 251/129.15
2009/0255516 A1 10/2009 Matsumoto

FOREIGN PATENT DOCUMENTS

CN 201526376 7/2010
CN 202764959 3/2013

* cited by examiner

*Primary Examiner* — Grant Moubry
(74) *Attorney, Agent, or Firm* — LeClairRyan

(57) ABSTRACT

An intake manifold integrated vacuum solenoid comprising a vacuum solenoid integrated into an intake manifold is provided. The solenoid includes a body and a pair of opposed attachment arms extending from the body. The body further includes an atmosphere port and a vacuum port defined by an annular collar. The collar includes at least one peripheral groove in which a sealing member is fitted. A conically-shaped bore is formed through the collar. The manifold includes an inlet into which the collar of the solenoid is fitted. The manifold further includes arm attachment posts to which the arms of the solenoid are attached. The arrangement for attaching the arms to the posts includes spools with each spool having a peripheral groove formed therein. Each spool is attached to its respective arm attachment post by a mechanical fastener. An end of each of the attachment arms is fitted into its respective spool.

17 Claims, 4 Drawing Sheets

INTAKE MANIFOLD INTEGRATED VACUUM SOLENOID

TECHNICAL FIELD

The disclosed inventive concept relates generally to vacuum solenoids and intake manifolds for internal combustion engines. More particularly, the disclosed inventive concept relates to an integrated solenoid for controlling a charge motion control valve (CMCV) vacuum system. The system supplies a vacuum to an actuator to operate a movable flap fitted inside the intake manifold runner.

BACKGROUND OF THE INVENTION

The intake manifold fitted to the modern automotive vehicle delivers incoming air from the air filter into the combustion chamber. Components associated with the intake manifold include the throttle body, the mass air flow sensor, various ducts and a fuel rail. The conventional intake manifold includes a plenum and an intake runner formed between the plenum and each cylinder.

The volume of the plenum and the geometry of the individual runner dictate engine performance. In the typical engine, the runner geometry is fixed. Engine performance may be modified by changing the volume of the plenum and the geometry of the runner. However, the fixed volume of the plenum and the fixed geometry of the runner, even when tuned for a specific engine and desired performance characteristics, are not perfectly suited for every engine speed. The most desirable aspect to adjust over different engine speeds is the length of the runner.

In an effort to improve engine performance, an active air intake manifold was developed which includes a valve to regulate the incoming air/fuel mix. An open valve forms a longer path for the incoming air/fuel mix, a condition that is desirable when the engine is operating at low revolutions. On the other hand, a closed valve shortens the runner path to improve engine performance when operating at high revolutions.

Another approach to improving engine performance is through the provision of a charge motion control valve (CMCV) system in which a flap is movably fitted in the primary runner. According to this system, the movable flap may partially and selectively block the air flow. By so doing, turbulence is created that helps improve fuel mixing at lower engine speeds.

In today's vehicle, the vacuum solenoid has several rubber hoses that connect it to the other parts of the intake system, including a vacuum hose to the intake manifold vacuum reservoir. These hoses take up space in the vehicle's engine compartment and add weight to the vehicle. The hoses also add material cost to the vehicle and require labor for their installation. Furthermore, experience has shown that rubber hoses introduce into the system an opportunity for leakage, thus causing vehicle performance problems. The problems associated with leaking hoses become more pronounced as the vehicle ages.

Thus known approaches to attaching the vacuum solenoid to the intake manifold reservoir are undesirable and impractical. Accordingly, an improved arrangement for associating the vacuum solenoid with the intake manifold remains wanting.

SUMMARY OF THE INVENTION

The disclosed inventive concept overcomes the problems associated with known solenoid designs. Particularly, the disclosed inventive concept provides an intake manifold arrangement that comprises an integrated vacuum solenoid and an intake manifold. The vacuum solenoid is plugged into the intake manifold reservoir via a sealing member. The integrated vacuum solenoid is operatively associated with the charge motion control valve system. The integrated solenoid of the disclosed inventive concept may be used to control both the valve in the active air intake as well as the flap in the CMCV system.

Particularly, the vacuum solenoid includes a body and a pair of opposed attachment arms extending from the body. The body further includes an atmosphere port and a vacuum port defined by an annular collar. The annular collar includes at least one peripheral groove in which a sealing member, such as an o-ring, is fitted. Alternatively, an o-ring seal may be provided between the base of the body and the outer surface of the manifold. A conically-shaped bore is formed centrally through the annular collar.

The intake manifold includes an inlet into which the annular collar of the vacuum solenoid is fitted. A fluid-tight seal is formed between the inlet of the intake manifold and the annular collar or the body of the vacuum solenoid by the sealing member. The intake manifold further includes arm attachment posts to which the opposed attachment arms of the vacuum solenoid are attached.

The arrangement for attaching the opposed attachment arms to the arm attachment posts includes spools with each spool having a peripheral groove formed therein. Each spool is attached to its respective arm attachment post by a mechanical fastener such as a bolt. An end of each of the attachment arms is fitted into its respective spool.

Each arm attachment post includes a bore in which a threaded sleeve insert is fitted. The mechanical fastener is threaded into the threaded insert for secure attachment of the vacuum solenoid to the intake manifold.

The arrangement of the intake manifold integrated vacuum solenoid according to the disclosed inventive concept eliminates hoses, thus reducing the possibility of operational failure due to hose leaks. The arrangement of the disclosed inventive concept also reduces manufacturing costs by eliminating the expense of the hoses while reducing labor cost that would otherwise be incurred through the need to attach the hoses.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

As those of ordinary skill in the art will understand, various features of the embodiments illustrated and described with reference to any one of the figures may be combined with features illustrated in one or more other figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations.

Figure 1:
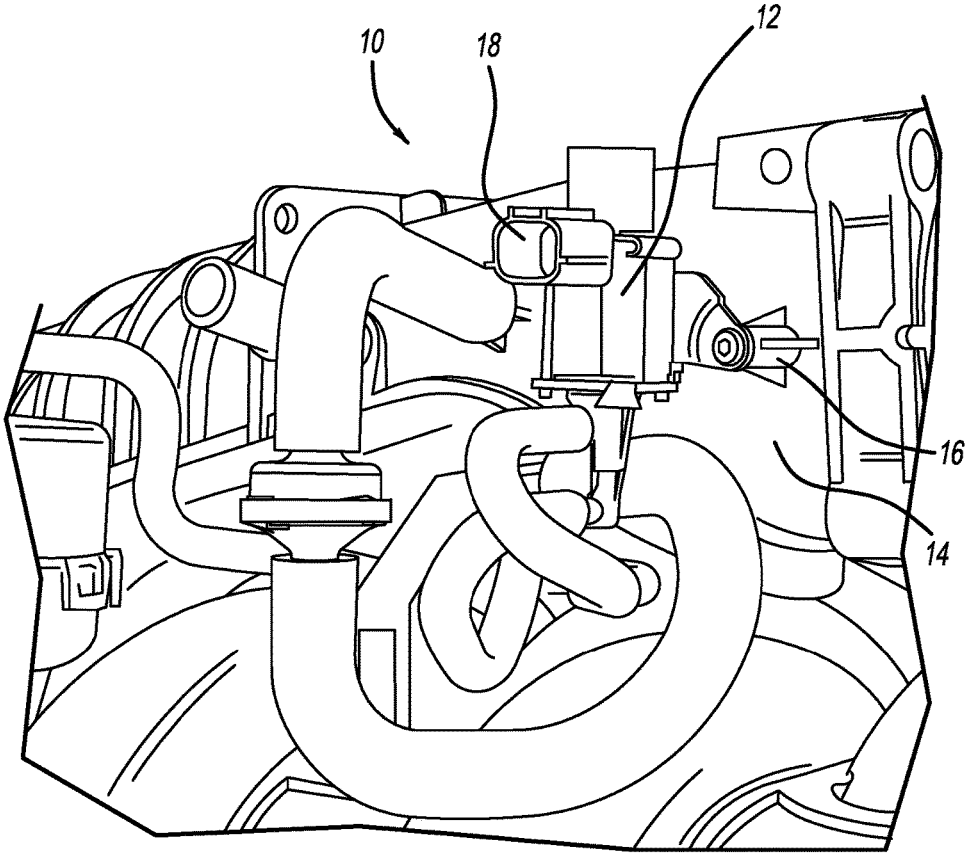
FIG. 1 is a view of a portion of an intake system attached to an intake manifold according to the disclosed inventive concept.

FIG. 1 illustrates a view of a portion of an intake system attached to an intake manifold according to the disclosed inventive concept. The intake system is generally illustrated as 10. The intake system 10 includes an integrated vacuum solenoid 12 that is attached to an intake manifold vacuum reservoir 14 by attachment posts, of which one, an attachment post 16, is shown in FIG. 1. An electric conduit port 18 is formed on the integrated vacuum solenoid 12. It is to be understood that the shape of the integrated vacuum solenoid 12 and its position on the intake manifold vacuum reservoir 14 illustrated in FIG. 1 are intended only as being suggestive and are not intended to be limiting.

Figure 2:
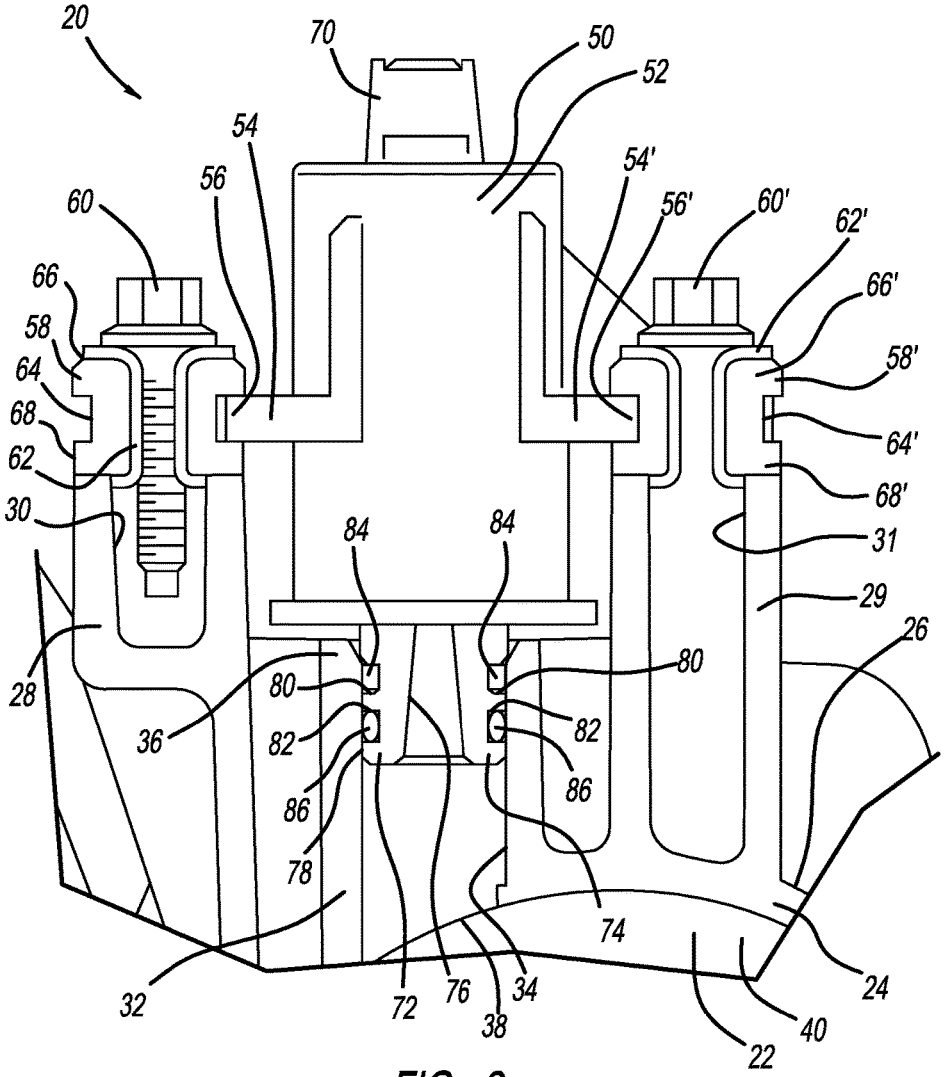
FIG. 2 is a side view of a solenoid valve integrated into an intake manifold according to one embodiment of the disclosed inventive concept illustrated in partial cross-section.
Figure 3:
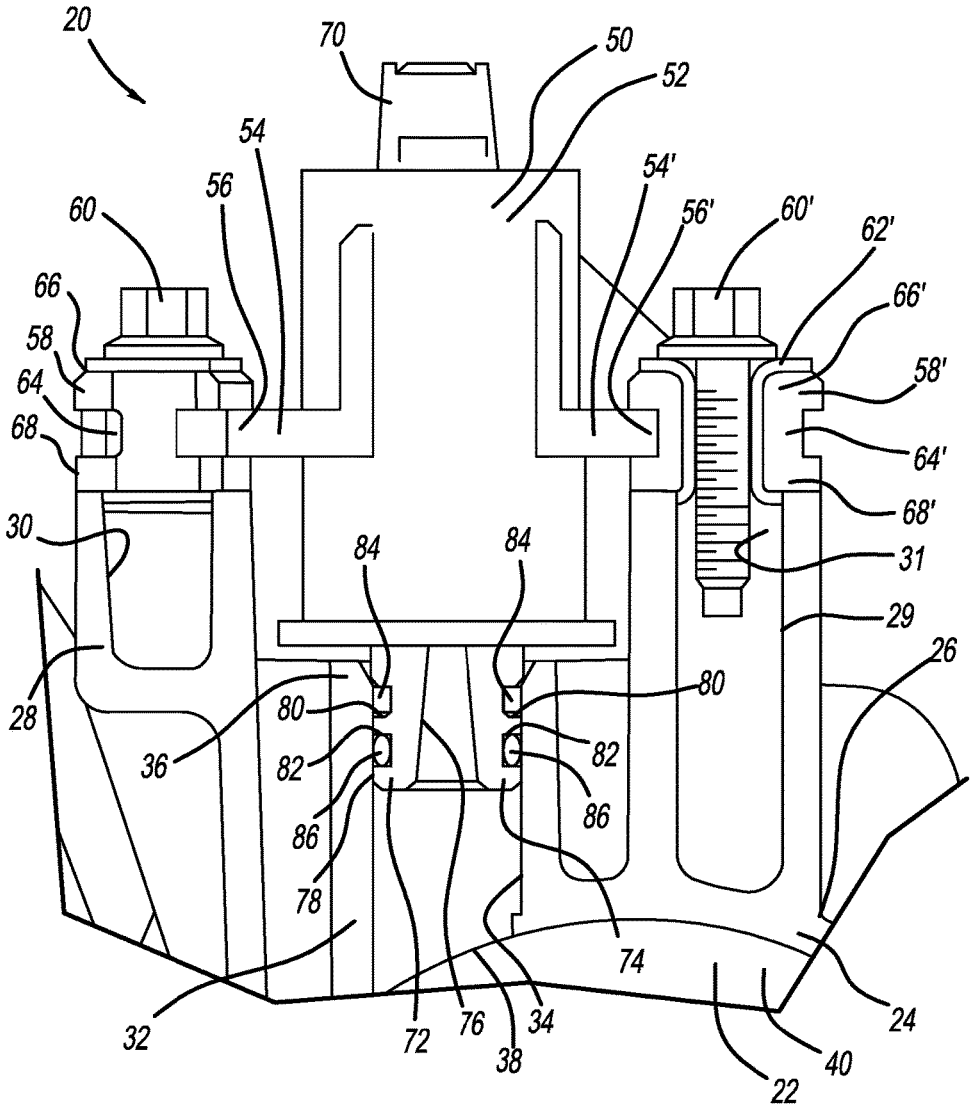
FIG. 3 is an alternative view of the solenoid valve integrated into an intake manifold according to the embodiment illustrated in FIG. 2.

FIGS. 2 and 3 illustrate side views of a solenoid valve integrated into an intake manifold according to one embodiment of the disclosed inventive concept illustrated in partial cross-section. The solenoid valve and intake manifold assembly, generally illustrated as 20, includes an intake manifold 22. The intake manifold 22 includes an intake manifold body 24. The intake manifold body 24 of the intake manifold 22 includes an outer surface 26 from which extend vacuum solenoid bracket attachment posts 28 and 29. The vacuum solenoid bracket attachment post 28 includes a bore 30 and the vacuum solenoid bracket attachment post 29 includes a bore 31.

A solenoid attachment post 32 extends from the body 24 of the intake manifold 22. A smooth bore 34 is formed within the solenoid attachment post 32. The smooth bore 34 is continuous between an open end 36 and a manifold end 38. The manifold end 38 is continuous with an intake manifold vacuum reservoir 40.

It is to be understood that the intake manifold 22 illustrated in FIGS. 2 and 3 is suggestive only and is not intended as being limiting. Possible variations of the intake manifold 22 include the shape of the body 24 and the number and positions of the attachment posts 28 and 29.

The solenoid valve and intake manifold assembly 20 includes an integrated solenoid valve 50. The integrated solenoid valve 50 includes a solenoid valve body 52. Formed within the solenoid valve body 52 but not illustrated are the components of a solenoid valve, including, but not limited to, a hollow solenoid winding, a movable solenoid core disposed substantially with the winding, a metal disc attached to the movable solenoid core for opening and closing the flow of gas through the valve, and a return spring. The arrangement and design of such components are known to those skilled in the art.

A pair of attachment arms 54 and 54' is provided perpendicular to the long axis of the solenoid valve body 52. The attachment arms 54 and 54' extend outwardly from the solenoid valve body 52. The attachment arm 54 includes an attachment end 56 and the attachment arm 54' includes an attachment end 56'.

A solenoid attachment spool 58 is attached to the attachment post 28 by a mechanical fastener such as a bolt 60. A solenoid attachment spool 58' is attached to the attachment post 29 by a mechanical fastener such as a bolt 60'. A threaded sleeve 62 is formed within the solenoid attachment spool 58. The threaded sleeve 62 (shown in FIG. 2) is positioned around at least a portion of the bolt 60. A threaded sleeve 62' (shown in FIG. 3) is formed within the solenoid attachment spool 58'. The threaded sleeve 62' is positioned around at least a portion of the bolt 60'.

The attachment spool 58 includes a peripheral groove 64 formed between an upper flange 66 and a lower flange 68. The attachment end 56 of the attachment arm 54 is slotted into the peripheral groove 64 of the attachment spool 58. The attachment spool 58' includes a peripheral groove 64' formed between an upper flange 66' and a lower flange 68'. The attachment end 56' of the attachment arm 54' is slotted into the peripheral groove 64' of the attachment spool 58'.

The solenoid valve body 52 includes an atmosphere port 70. The solenoid valve body 52 also includes a vacuum port 72. The vacuum port 72 is partially defined by an annular collar 74 having an inner, conically-shaped bore 76 and an outer surface 78. The annular collar 74 is substantially disposed within the smooth bore 34 of the solenoid attachment post 32.

Peripherally formed on the outer surface 78 is a pair of spaced apart grooves 80 and 82. An o-ring 84 is positioned in the groove 82 and an o-ring 86 is positioned in the groove 82. A greater or lesser number of o-rings may be provided. The o-ring 84 provides a fluid-tight seal between the annular collar 74 and the smooth bore 34 of the solenoid attachment post 32. Thus the annular collar 74 of the integrated solenoid valve 50 is plugged into the intake manifold vacuum reservoir 40 via the o-rings 84 and 86.

Figure 4:
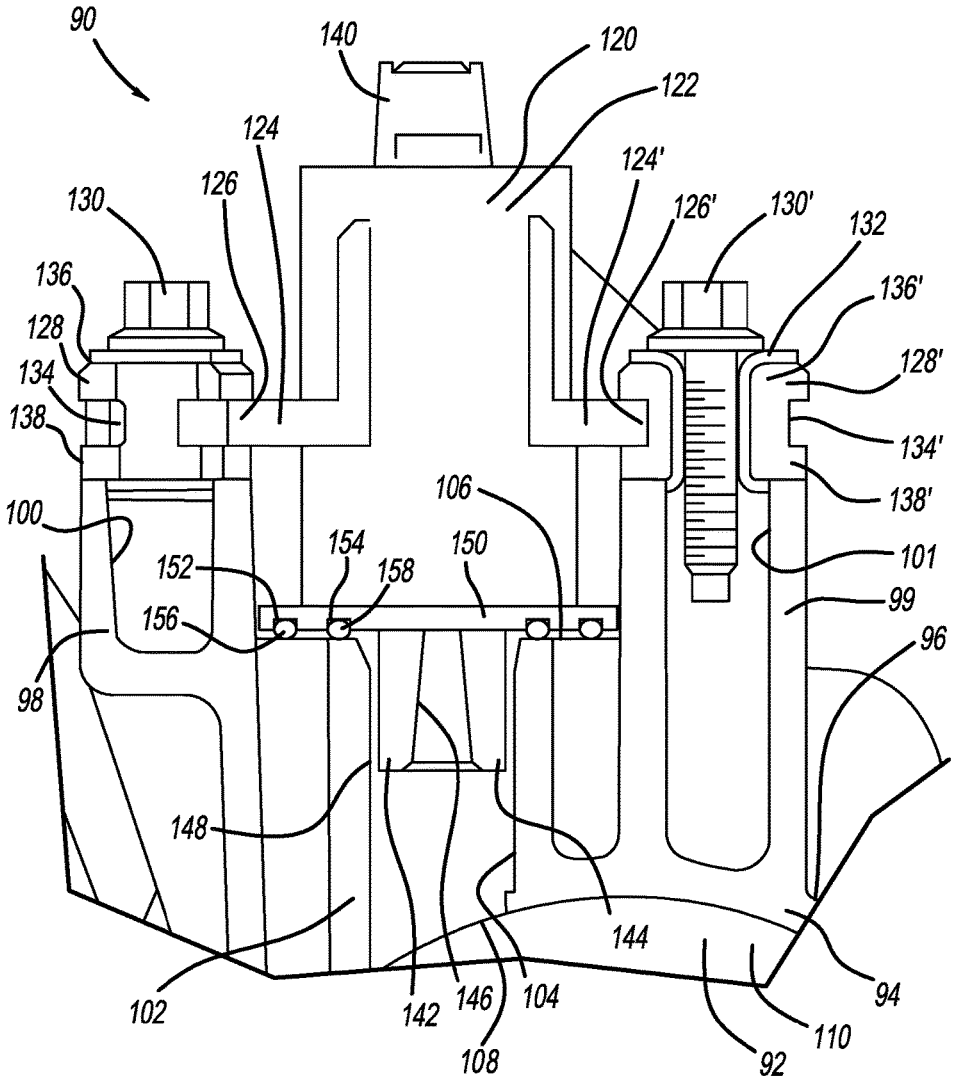
FIG. 4 is a side view of a solenoid valve integrated into an intake manifold according to another embodiment of the disclosed inventive concept illustrated in partial cross-section.

FIG. 4 illustrates a side view of a solenoid valve integrated into an intake manifold according to another embodiment of the disclosed inventive concept illustrated in partial cross-section. According to this embodiment, a solenoid valve and intake manifold assembly, generally illustrated as 90, includes an intake manifold 92. The intake manifold 92 includes an intake manifold body 94. The intake manifold body 94 of the intake manifold 92 includes an outer surface 96 from which extend vacuum solenoid bracket attachment posts 98 and 99. The vacuum solenoid bracket attachment post 98 includes a bore 100 and the vacuum solenoid bracket attachment post 99 includes a bore 101.

A solenoid attachment post 102 extends from the body 94 of the intake manifold 92. A smooth bore 104 is formed within the solenoid attachment post 102. The smooth bore 104 is adjacent an end wall 106 formed in the body 94 of the intake manifold 92. The smooth bore 104 is continuous between an the end wall 106 and a manifold end 108. The manifold end 108 is continuous with an intake manifold vacuum reservoir 110.

The solenoid valve and intake manifold assembly 90 includes an integrated solenoid valve 120. The integrated solenoid valve 120 includes a solenoid valve body 122. A pair of attachment arms 124 and 124' is provided perpendicular to the long axis of the solenoid valve body 122. The attachment arms 124 and 124' extend outwardly from the solenoid valve body 122. The attachment arm 124 includes an attachment end 126 and the attachment arm 124' includes an attachment end 126'.

A solenoid attachment spool 128 is attached to the attachment post 98 by a mechanical fastener such as a bolt 130. A solenoid attachment spool 128' is attached to the attachment post 99 by a mechanical fastener such as a bolt 130'. A threaded sleeve 132 is formed within the solenoid attachment spool 128'.

The attachment spool 128 includes a peripheral groove 134 formed between an upper flange 136 and a lower flange 138. The attachment end 126 of the attachment arm 124 is slotted into the peripheral groove 134 of the attachment spool 128. The attachment spool 128' includes a peripheral groove 134' formed between an upper flange 136' and a lower flange 138'. The attachment end 126' of the attachment arm 124' is slotted into the peripheral groove 134' of the attachment spool 128'.

The solenoid valve body 122 includes an atmosphere port 140. The solenoid valve body 122 also includes a vacuum port 142. The vacuum port 142 is partially defined by an annular collar 144 having an inner, conically-shaped bore 146 and an outer surface 148. The annular collar 144 is substantially disposed within the smooth bore 104 of the solenoid attachment post 102.

The solenoid valve body 122 includes a base 150. The base 150 includes at least one groove 152 and may include a second concentric groove 154. An o-ring 156 is positioned in the groove 152 and, if the second concentric groove 154 is provided, an o-ring 158 is positioned in the groove 154. A greater number of concentric o-rings may be provided. The o-ring 156 provides a fluid-tight seal between the annular collar 144 and the smooth bore 100 of the solenoid attachment post 102. Thus the annular collar 144 of the integrated solenoid valve 120 is plugged into the intake manifold vacuum reservoir 110 via the o-rings 154 and 156.

The embodiments of the disclosed inventive concept overcome challenges faced by known, multi-tube arrangements by providing direct contact between the vacuum solenoid and the intake manifold. The arrangement is efficient and is not susceptible to wear and consequent leaks known in current technology. Both material cost and labor cost are reduced by adopting the disclosed arrangement in which the vacuum solenoid is integrated with the intake manifold.

One skilled in the art will readily recognize from such discussion, and from the accompanying drawings and claims that various changes, modifications and variations can be made therein without departing from the true spirit and fair scope of the invention as defined by the following claims.

What is claimed is:

1. A vacuum solenoid and intake manifold arrangement comprising:

a vacuum solenoid having a body, said body having an intake manifold attachment arm and an annular collar defining a vacuum port, said body having a base, said base having a groove formed therein;

a sealing member fitted in said groove; and an intake manifold vacuum reservoir having an inlet into which said collar is fitted, said manifold further including a post to which said arm is attached, said post including a bore and a threaded sleeve inserted into said bore.

2. The vacuum solenoid and intake manifold arrangement of claim 1 wherein said solenoid includes an inlet port.

3. The vacuum solenoid and intake manifold arrangement of claim 1 wherein said annular collar includes a centrally-formed, conically-shaped bore.

4. The vacuum solenoid and intake manifold arrangement of claim 1 further including a peripheral groove formed in said collar and a sealing member fitted in said groove.

5. The vacuum solenoid and intake manifold arrangement of claim 4 wherein said sealing member is an o-ring.

6. The vacuum solenoid and intake manifold arrangement of claim 1 further including an attachment spool having a peripheral groove, said attachment arm being fitted to said groove of said spool said spool being fitted to said arm attachment post.

7. A vacuum solenoid and intake manifold arrangement for an internal combustion engine comprising:

a vacuum solenoid having a body, said body having an intake manifold attachment arm and an annular collar defining a vacuum port, said collar having a peripheral groove;

a sealing member fitted in said groove;

an intake manifold vacuum reservoir having an inlet into which said collar is fitted, said manifold further including an arm attachment post to which said arm is attached, said arm attachment post including a bore and a threaded sleeve inserted into said bore.

8. The vacuum solenoid and intake manifold arrangement of claim 7 wherein said solenoid includes an inlet port.

9. The vacuum solenoid and intake manifold arrangement of claim 7 wherein said annular collar includes a centrally-formed, conically-shaped bore.

10. The vacuum solenoid and intake manifold arrangement of claim 7 wherein two spaced apart peripheral grooves are formed in said collar, each of said grooves including a sealing member.

11. The vacuum solenoid and intake manifold arrangement of claim 10 wherein said sealing member is an o-ring.

12. The vacuum solenoid and intake manifold arrangement of claim 7 further including an attachment spool having a peripheral groove, said attachment arm being fitted to said groove, said spool being fitted to said arm attachment post.

13. The vacuum solenoid and intake manifold arrangement of claim 7 further including a mechanical fastener for attaching said attachment arm to said arm attachment post.

14. The vacuum solenoid and intake manifold arrangement of claim 7 further including a pair of opposed attachment arms, a pair of arm attachment posts to which said opposed arms are attached, and a pair of mechanical fasteners for attaching said opposed attachment arms to said arm attachment posts.

15. A vacuum solenoid and intake manifold arrangement for an internal combustion engine comprising:

a vacuum solenoid having a body, said body having an intake manifold attachment arm, a base wall, and an annular collar having a centrally-formed, conically-shaped bore;

a seal selected from the group consisting of an o-ring seal fitted to said collar and an o-ring seal fitted to said base wall;

an intake manifold vacuum reservoir having an inlet into which said collar is fitted, said manifold further including an arm attachment post to which said attachment arm is attached, said arm attachment post including a bore and a threaded sleeve inserted into said bore.

16. The vacuum solenoid and intake manifold arrangement of claim 15 wherein said solenoid includes an inlet port and wherein said annular collar defines a vacuum port.

17. The vacuum solenoid and intake manifold arrangement of claim 15 wherein said attachment arm comprises two attachment arms and wherein said arm attachment post comprises two attachment posts and wherein said arrangement further includes a first attachment spool and a second attachment spool, each spool having a peripheral groove, one of said attachment arms being fitted to said groove of said first spool and the other of said attachment arms being fitted to said groove of said second spool, said spools being fitted to said arm attachment posts.

* * * * *